US005103607A

United States Patent [19]

Bard

[11] Patent Number: 5,103,607

[45] Date of Patent: Apr. 14, 1992

[54] CHANNEL ELEMENT FOR GROUND CHANNELS IN SWIMMING-POOLS WITH VERTICAL WATER FLOW

[75] Inventor: Martin Bard, Amberg, Fed. Rep. of Germany

[73] Assignee: Buchtal Gesellschaft mit beschraenkter Haftung, Schwarzenfeld, Fed. Rep. of Germany

[21] Appl. No.: 410,634

[22] Filed: Sep. 21, 1989

[30] Foreign Application Priority Data

Sep. 22, 1988 [DE] Fed. Rep. of Germany ..... 3832285
Apr. 21, 1989 [DE] Fed. Rep. of Germany ... 8904841[U]

[51] Int. Cl.[5] ..... E02D 19/22; E06B 7/14

[52] U.S. Cl. ..... 52/169.5; 52/209; 52/220; 4/510

[58] Field of Search ..... 52/220, 221, 169.5, 52/209; 4/506, 507, 508, 510

[56] References Cited

FOREIGN PATENT DOCUMENTS 1274317 8/1968 Fed. Rep. of Germany ..... 52/220
2448630 4/1976 Fed. Rep. of Germany .
2718525 12/1977 Fed. Rep. of Germany ..... 4/510

*Primary Examiner*—David A. Scherbel
*Assistant Examiner*—K. Nguyen
*Attorney, Agent, or Firm*—Price, Heneveld, Cooper, DeWitt & Litton

[57] ABSTRACT

A channel element used in swimming-pool ground channels which house water-bearing pipes and receive a latchable cover that includes a box-like shaped body, preferably made of burnt ceramic material, which fits into the ground channel groove and includes on opposite inside wall surfaces integral projections or recesses that form detents to latch the cover.

A separate sheet bearing the proposed Abstract of the Disclosure is enclosed herewith for the Patent Office's convenience in amending the application.

20 Claims, 2 Drawing Sheets

CHANNEL ELEMENT FOR GROUND CHANNELS IN SWIMMING-POOLS WITH VERTICAL WATER FLOW

The present invention relates to a channel element for ground channels adapted to receive latchable covering profile members of plastic material in swimming-pools with vertical water flow.

In swimming-pools it is necessary to circulate the water several times a day and to lead it through appropriate filter elements in order to remove impurities from the water. In public swimming-pools there is a tendency to increase the number of circulations or revolutions from three times to eight times a day. This object, however, cannot be achieved with the pumping plants and pipe conduit diameters available in older swimming-pools, but rather requires considerable alterations and installations.

More recent swimming-pools are more and more operated according to the principle of vertical water flow, in which water is supplied from the ground of the swimming-pool via channel systems and discharged via gutters arranged on the upper lateral sides of the swimming-pool. This vertical water flow makes use of the experience that most of the impurities in the water, particularly organic and oxidizable substances, are concentrated in the surface water, which means that about 95% of all impurities are to be found in the uppermost water layer. In contrast thereto, the water in deeper areas of the pool is substantially as good and clean as the water subsequent to treatment by passage through filter elements and the like. According to the principle of vertical water flow, the water is not sucked off from the ground of the pool or from the lower areas of the pool walls, something that would be a waste of energy in view of the above explanations, but the water, after passage through filter elements, is fed via ground channels provided in the ground of the swimming-pool, which finally results in a water flow from the pool ground to the upper surface.

The ground channels extend longitudinally in the ground of the swimming-pool and are arranged parallel to each other. Each of the ground channels houses a water-bearing pipe. On the upper side, the ground channels are covered by covering profile members of plastic material, particularly of PVC, in which outlet openings for water exit are provided. The treated water which is fed via the pipes arranged in the ground channels then flows through the outlet openings in the covering profile members into the swimming-pool.

According to hitherto prevailing techniques, the covering profile members are provided on their edges with web-like latch members so that the covering profile members can be latched in supporting profiles provided laterally in the ground channels. Such supporting profiles are made of plastics and have the form of longitudinally extending ridges which comprise a vertical leg, on which detent projections or detent recesses complementary to those of the covering profile member are arranged. Support bars project backward on the reverse of the vertical leg, one lower support bar of which together with the lower area of the vertical leg defines an angle, by means of which the support profile is placed on the lateral edge of a channel cut out in the ground. An upper, backwardly extending leg forms the cover bar of the support profile, which cover bar thus constitutes the transition between the covering profile member and the adjacent ceramic lining on the ground of the basin. The use of such plastics profile members requires precise building of the channels and observing very narrow tolerances for the width, linearity and the position in vertical sense of the channels which receive the water-bearing pipes and the covering profile members. Since this cannot be achieved by means of simple encasings, corresponding work and costs for such channels are involved for manufacturing the ground of the basin. It is also troublesome to fasten the supporting profiles since they must be doweled with the floor very carefully. Also the spacing and the position in vertical sense of these supporting profiles are of great importance because the cover bar must be substantially flush with the ceramic lining. Further, in case of doweled plastics profile members there is a risk that they get loose gradually, something that may finally result in a disengagement of the covering profile members. Due to the problems associated with connecting these supporting profiles to the surrounding plating and the work and costs involved for mounting and fastening the supporting profiles such ground channels are comparatively costly. Further, this work cannot be done by a tile layer, who is responsible for the ceramic lining of the swimming-pool. Instead, these ground channels must be prepared in coordination with workers responsible for the manufacture of the ground of the basin. Re-equipping of older swimming-pools so as to adapt them for vertical water flow is overly expensive for the reasons of expenditure shown above and thus often not acceptable.

It is the object of this invention to provide for a ground channel for swimming-pools with vertical water flow, which can be easily manufactured at low costs.

According to the invention, this object is achieved by a channel element which is constituted by a box-like shaped body made of burnt ceramic material which is adapted to fit into the channel groove and on whose opposing inside wall surfaces there are arranged detent projections or detent recesses which are designed integral with said box-like shaped body for latching the covering profile member. Further suitable improvements of the invention are characterized by the features contained in the subclaims.

As provided for by the invention, the covering profile members are received by a box-like shaped body of the type of a shaped brick made of burnt ceramic material, which, in respect of its latch members cooperating with the latch members of the covering profile member, can be precisely manufactured, but can also be laid in a simple manner in grooves in the ground of the basin by means of a mortar bed. The advantage thereof resides in that these channel grooves need no longer be manufactured with the narrow tolerances required for the plastics support profiles in respect of width, alignment and position in vertical sense, but that it is possible to achieve a compensation by means of the mortar bed, into which the shaped body is placed. Thereby the system of vertical water flow can be readily transferred to older swimming-pools, because only roughly precise grooves are to be prepared in the basin ground, into which grooves the box-like shaped bodies are then placed via a mortar bed. Also the lateral connection of the shaped bricks to the ceramic plating can be easily achieved. Dowels or the like are not required. Further, damaged parts can be replaced without difficulty, because the shaped bricks can be removed later from the mortar bed with the aid of appropriate tools and replaced with new shaped bricks. Due to the position of the latch members fixed by the box-like shaped body, latching of the covering profile members is always ensured.

Finally, the shaped bricks can readily be laid by the tile layer who also prepares the ceramic lining of the swimming basin. He only needs to lay the shaped brick, that is the box-like shaped body, into the groove in the ground concrete by use of a mortar bed, then apply the filling concrete and finally lay the ceramic tiles accurately to size. For the mortar bed epoxide mortar is particularly suited. Due to the predetermined spacings of the opposing detent projections of the shaped brick the covering profile members can be mounted in a simple manner.

According to a suitable embodiment the box-like shaped body is designed in one part and substantially U-shaped. The one-part design offers the advantage that the box-like shaped body can be laid as one single structural unit. On the other hand, when the shaped body is designed as one part, its overall length is limited to a certain extent. Therefore, in order to obtain larger overall lengths, it is expedient to use multi-part shaped bodies.

In a particularly advantageous embodiment the box-like shaped body is composed of two shaped bricks, each of which is constituted by an L-shaped angular member.

For reinforcing the attachment it is expedient to form recesses or projections on the contact surfaces of the shaped brick with the mortar bed in order to achieve a certain anchoring between the shaped brick and the mortar bed.

DESCRIPTION OF THE PREFERRED EMBODIMENT

Figure 1:
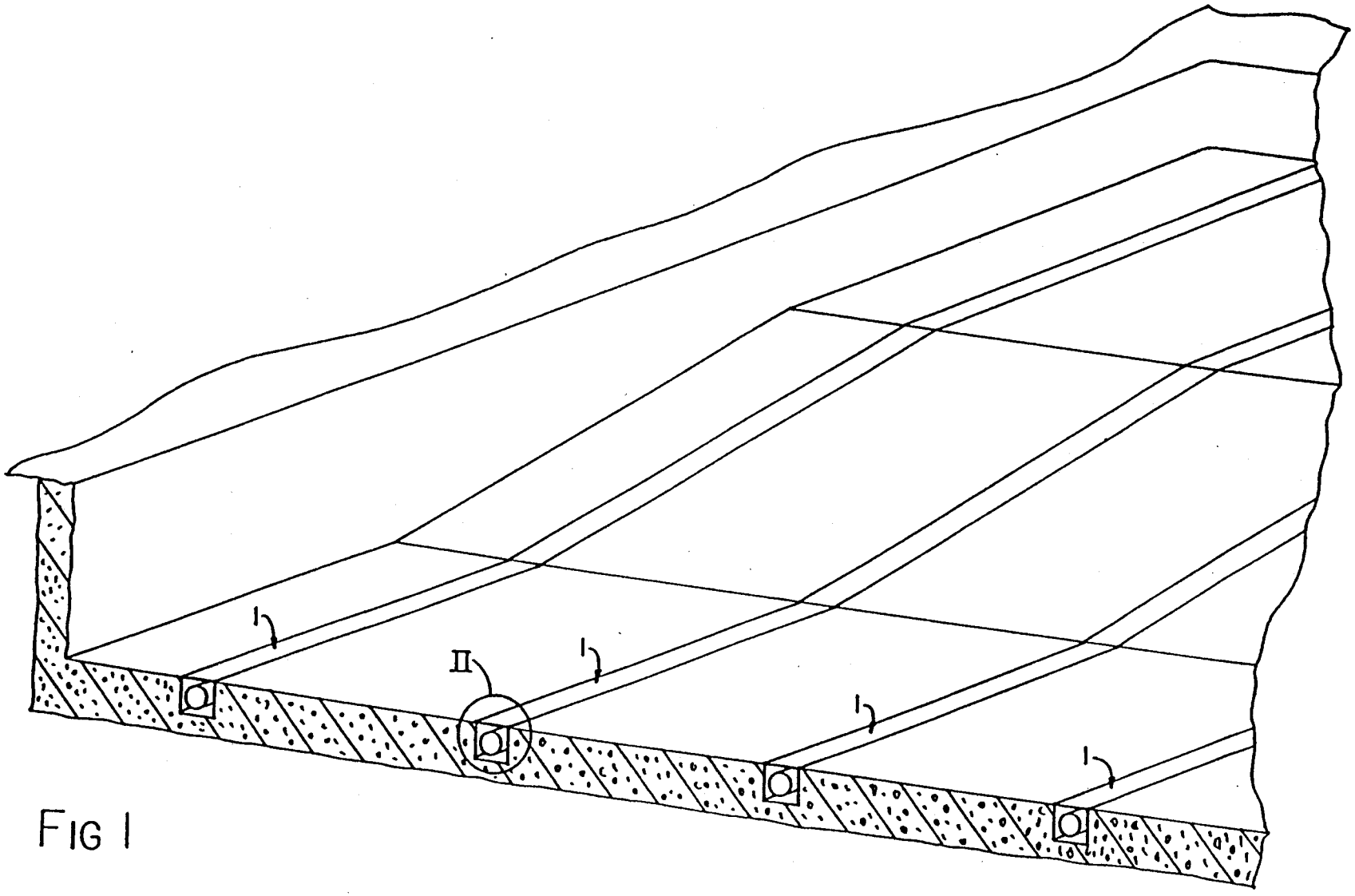
FIG. 1 is a fragmentary perspective view showing the present invention in a swimming pool.
Figure 2:
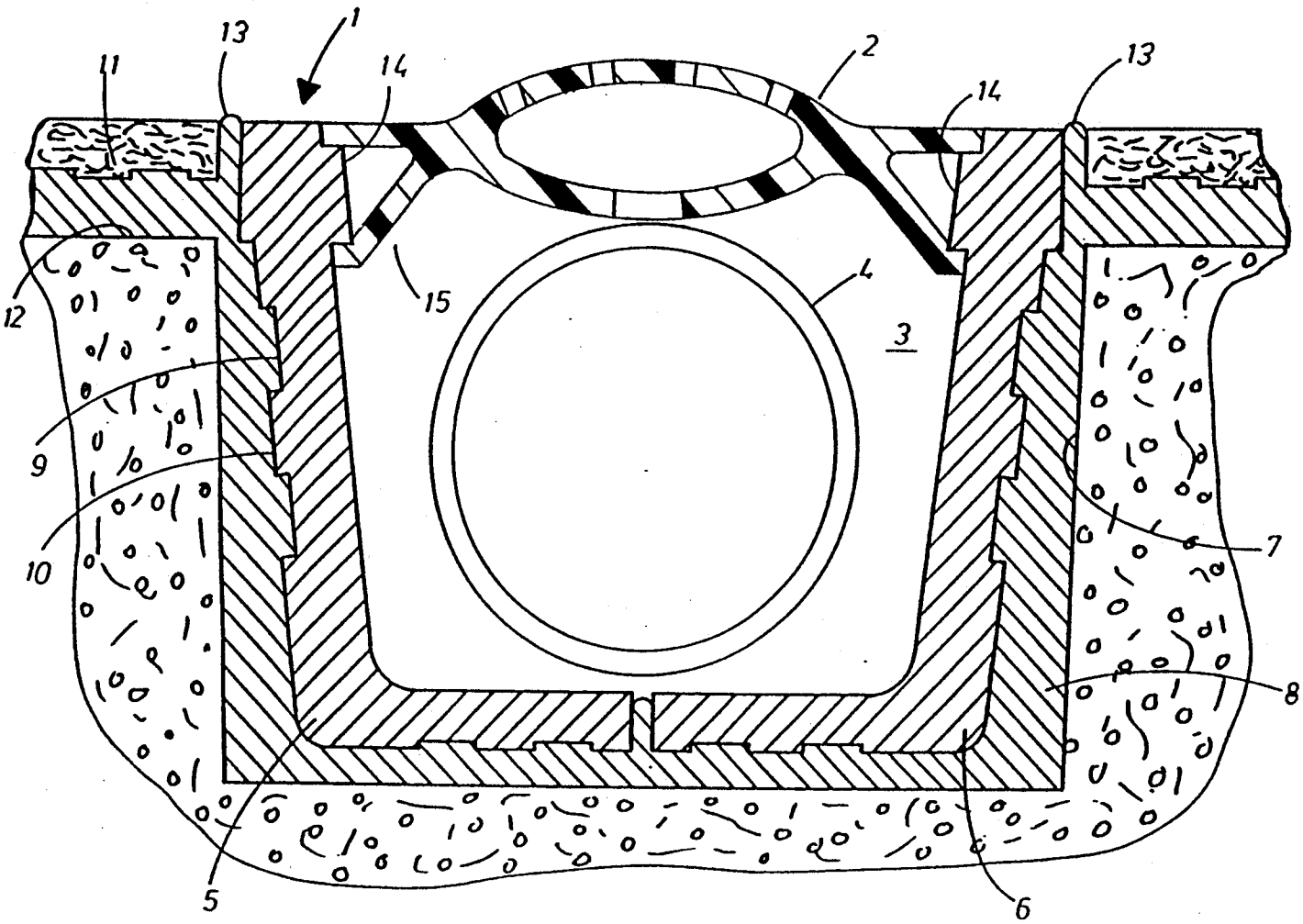
FIG. 2 is an enlarged, fragmentary cross-sectional view of detail II of FIG. 1.

A preferred embodiment of the invention is described hereinafter, reference being had to the accompanying drawings which show sectional views through a ground channel of a vertical water flow swimming-pool with a channel element according to the invention.

In the Figure, the channel element is constituted by a box-like shaped body generally designated by the reference numeral 1, which receives a latchable covering profile member 2 of plastic material and defines by its inside surfaces a channel 3. Reference numeral 4 designates a pipe for supplying water to the channel. The box-like shaped body 1 of the embodiment as shown consists of two parts, namely of two substantially L-shaped angular members 5 and 6, which are constituted by shaped bricks made of burnt ceramic material. The shaped bricks 5 and 6, taken together, generally define a U-form and are placed into a channel lining 7 in the ground of the swimming-pool and fastened in the channel groove 7 by means of a mortar bed 8. Groove-like recesses 9 and/or projections 10 serve to enlarge the contact surface with the mortar bed 8 and thus to intensify the attachment of the box-like shaped body 1 via the mortar bed 8 to the ground of the swimming-pool.

11 designates the ceramic lining of ceramic tiles or plates on the ground 12 of the swimming-pool, which are fastened on the ground in a conventional manner by means of a mortar bed. The connection between the box-like shaped body 1 thoroughly placed by means of the mortar bed 8 and the plating of ceramic tiles 11 is achieved by a conventional jointing at 13.

On the inside surfaces, particularly at the upper edge of the box-like shaped body 1, there are arranged detent projections 14 integral with said body or shaped brick, which may be engaged by corresponding latch members 15 of the covering profile member 2. Depending on the design of the covering profile member 2, more precisely of the latches of the covering profile member 2, the upper edge of the box-like shaped body 1 may also be provided with appropriate recesses, into which the latch members of the covering profile member 2 can snap.

As an alternative to the embodiment as shown, the box-like shaped body may be designed as a U-shaped tub or it may also be composed of two or more parts. In case of a triple division, suitably the bottom part as well as the two wall legs of the body 1 are designed as separate parts and can thus also be laid separately via the mortar bed. The multi-part design of the box-like shaped body not only provides the advantage of better accuracy to size of the burnt ceramic shaped bricks, but also facilitates subsequent repair works, because only parts of the box-like shaped body need to be removed and can be replaced as such.

In the embodiment as shown the detent projection 14 is defined by a bulge-like rib extending in the longitudinal direction of the box-like shaped body. The length of said body is suitably about 30 to 40 cm, which allows for the shaped brick to be laid in a convenient manner.

Due to the advantages offered by the shaped brick, the channel system can be mounted by the tile layer who also lays the ceramic tiles for the ceramic lining of the swimming-pool. As a preliminary measure for preparing the tile layer's work, only appropriate channel grooves are made in the ground concrete when an entirely new swimming-pool is built, or the the tile layer places the channel element according to the height, the direction and the distance on the bottom surface of an old swimming-pool that is to be rehabilitated. In both cases the attachment is effected by means of a mortar bed, and also the exact fitting-in and adjustment of the channel element are achieved by means of such mortar bed. Therefore, the groove previously to be made in the ground concrete can be prepared without taking care of narrow tolerances, something that considerably facilitates the installation of such channel system. Also the order in which the laying and mounting steps are performed can be selected as desired. For instance, first the ceramic lining between the channels may be laid and then the channel elements may be fit into the existing spaces, or first the channel elements are laid and then the surfaces lying therebetween on the ground of the swimming-pool are lined with ceramics.

In case of a multi-part structure the tile layer can place the box-like shaped body into the mortar bed, or the box-like shaped body is partwise prefabricated and then fastened as a unity in the groove by means of acid-proof compound mortar.

What is claimed is:

1. A channel element for ground channels adapted to receive latchable covering profile members of plastic material in swimming-pools with vertical water flow, said channel element comprising a box-like shaped body made of burnt ceramic material which is adapted to fit into a ground channel groove, said channel element having opposing inside wall surfaces that include detent members, said detent members comprising one of detent projections and detent recesses, said detent members formed integral with said box-like shaped body for securing said covering profile member.

2. A channel element according to claim 1, wherein said box-like shaped body comprises a one-part and substantially U-shaped brick construction having a bottom and side walls, said box-like shaped body being fixed in said ground channel groove by means of a mortar bed.

3. A channel element according to claim 2, wherein said box-like shaped body and said mortar bed have contact surfaces, and said contact surfaces include one of a set of recesses and a set of retaining projections.

4. A channel element according to claim 3, wherein each said detent projection comprises an inwardly projecting rib extending over the entire length of said channel element and being integral therewith.

5. A channel element according to claim 2, wherein each said detent projection comprises an inwardly projecting rib extending over the entire length of said channel element and being integral therewith.

6. A channel element according to claim 1, wherein each box-like shaped body comprises a substantially U-shaped box-like body having a bottom and side walls and is constructed as multi-part article including regions of shaped bricks, and that said regions of shaped bricks are fixed by said bottom and side walls in said ground channel groove by means of a mortar bed.

7. A channel element according to claim 6, wherein said box-like shaped body is divided at the middle of said bottom, and is comprised of two shaped bricks having the form of L-shaped angular members.

8. A channel element according to claim 7, wherein the parts of said multi-part article are connected in a force-locking manner by means of an acid-proof compound mortar of an epoxide resin basis.

9. A channel element according to claim 8, wherein said box-like shaped body and said mortar bed have contact surfaces, and said contact surfaces include one of a set of recesses and a set of retaining projections.

10. A channel element according to claim 8, wherein each said detent projection comprises an inwardly projecting rib extending over the entire length of said channel element and being integral therewith.

11. A channel element according to claim 7, wherein said box-like shaped body and said mortar bed have contact surfaces, and said contact surfaces include one of a set of recesses and a set of retaining projections.

12. A channel element according to claim 7, wherein each said detent projection comprises an inwardly projecting rib extending over the entire length of said channel element and being integral therewith.

13. A channel element according to claim 6, wherein the parts of said multi-part article are connected in a force-locking manner by means of an acid-proof compound mortar of an epoxide resin basis.

14. A channel element according to claim 13, wherein said box-like shaped body and said mortar bed have contact surfaces, and said contact surfaces include one of a set of recesses and a set of retaining projections.

15. A channel element according to claim 14, wherein each said detent projection comprises an inwardly projecting rib extending over the entire length of said channel element and being integral therewith.

16. A channel element according to claim 13, wherein each said detent projection comprises an inwardly projecting rib extending over the entire length of said channel element and being integral therewith.

17. A channel element according to claim 6, wherein said box-like shaped body and said mortar bed have contact surfaces, and said contact surfaces include one of a set of recesses and a set of retaining projections.

18. A channel element according to claim 17, wherein each said detent projection comprises an inwardly projecting rib extending over the entire length of said channel element said being integral therewith.

19. A channel element according to claim 6, wherein each said detent projection comprises an inwardly projecting rib extending over the entire length of said channel element and being integral therewith.

20. A channel element according to claim 1, wherein each said detent projection comprises an inwardly projecting rib extending over the entire length of said channel element and being integral therewith.

* * * * *

UNITED STATES PATENT AND TRADEMARK OFFICE

CERTIFICATE OF CORRECTION

PATENT NO. : 5,103,607

DATED : April 14, 1992

INVENTOR(S) : Martin Bard

It is certified that error appears in the above-indentified patent and that said Letters Patent is hereby corrected as shown below:

On the Title Page, Item [57], paragraph 2, Delete "A separate sheet nearing the proposed Abstract of the Disclosure is enclosed herewith for the Patent Office's convenience in amending the application."

Column 5, line 24, "each" should read --said--.

Column 5, line 26, after "as" insert --a--.

Signed and Sealed this

Sixth Day of September, 1994

Bruce Lehman

*Attest:*

BRUCE LEHMAN

*Attesting Officer*

*Commissioner of Patents and Trademarks*